US006889879B2

(12) United States Patent
Rivera et al.

(10) Patent No.: US 6,889,879 B2
(45) Date of Patent: May 10, 2005

(54) CARRIER FOR ATTACHING A MULTIPURPOSE TOOL TO A BELT

(75) Inventors: Benjamin C. Rivera, West Linn, OR (US); Nathan E. Knight, Portland, OR (US); Bernd Heinrichs, Vancouver, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 138 days.

(21) Appl. No.: 10/066,138

(22) Filed: Jan. 30, 2002

(65) Prior Publication Data

US 2003/0141332 A1 Jul. 31, 2003

(51) Int. Cl.[7] ..... B65D 25/04; B65D 25/10; A45F 5/00

(52) U.S. Cl. ..... 224/245; 224/269; 224/904

(58) Field of Search ..... 24/3.7, 3.12; 224/245, 224/269, 668, 904, 930, 242

(56) References Cited

U.S. PATENT DOCUMENTS

| | | | | | |
|---|---|---|---|---|---|
| 118,228 | A | | 8/1871 | Frey | |
| 307,655 | A | | 11/1884 | Jacob | |
| 2,138,978 | A | | 12/1938 | Meine | 224/2 |
| 3,021,101 | A | | 2/1962 | Gliebe | 248/44 |
| D193,678 | S | * | 9/1962 | Goldman | D3/228 |
| 3,233,802 | A | * | 2/1966 | Ludwick | 224/183 |
| 3,250,448 | A | | 5/1966 | Clark | 224/2 |
| 3,300,109 | A | | 1/1967 | Clark | 224/2 |
| 3,668,802 | A | * | 6/1972 | Benward | 43/57.1 |
| 4,667,374 | A | | 5/1987 | Bianchi | 24/3 |
| 4,821,934 | A | | 4/1989 | Alessi et al. | 224/252 |
| 5,261,583 | A | | 11/1993 | Long et al. | 224/245 |
| 5,351,868 | A | | 10/1994 | Beletsky et al. | 224/245 |
| 5,379,490 | A | * | 1/1995 | Wandt et al. | 24/3.11 |
| 5,697,538 | A | * | 12/1997 | Goldenberg et al. | 224/676 |
| D392,097 | S | | 3/1998 | Pottala et al. | D3/218 |
| 5,755,367 | A | * | 5/1998 | Yamada | 224/245 |
| D415,890 | S | | 11/1999 | Eriksson et al. | D3/229 |
| 5,983,458 | A | | 11/1999 | Jackson | 24/3.12 |
| D425,907 | S | | 5/2000 | Frye et al. | D14/248 |
| 6,105,923 | A | | 8/2000 | Robertson et al. | 248/682 |
| 6,149,043 | A | * | 11/2000 | Goto | 224/669 |
| D434,898 | S | | 12/2000 | Jokinen et al. | D3/218 |
| 6,264,079 | B1 | | 7/2001 | Skaggs | 224/193 |
| 6,269,993 | B1 | | 8/2001 | Ebejer et al. | 224/674 |
| 6,279,362 | B1 | | 8/2001 | Lee | 70/456 |
| 6,443,343 | B2 | * | 9/2002 | Kamiya | 224/269 |

OTHER PUBLICATIONS

Wave Rider—Aluminum Sheath—Ebay Advertisement dated Aug. 14, 2001.

* cited by examiner

*Primary Examiner*—Sue A. Weaver
(74) *Attorney, Agent, or Firm*—Chernoff, Vilhauer, McClung & Stenzel, LLP

(57) ABSTRACT

A carrier for an article such as a folded multipurpose hand tool. The carrier is molded of a stiff but resiliently flexible material and includes a body to which is attached an arm that can be placed around a person's belt. The arm has a hook at its lower end that can be latched into mating engagement in a receptacle in the body of the carrier. Grip members hold an article securely in the carrier. Ears on the sides of the carrier can be used to hold the carrier while the article carried is being removed from the carrier.

27 Claims, 7 Drawing Sheets

CARRIER FOR ATTACHING A MULTIPURPOSE TOOL TO A BELT

BACKGROUND OF THE INVENTION

The present invention relates to a carrier for holding a small article on a person's belt and, in particular, relates to a sheath or similar carrier for a useful article such as a folded multipurpose tool.

Various sheaths, pouches, holsters and other types of carriers are well-known for keeping pagers, wireless telephones, knives, multipurpose tools and other small articles on a person's belt where they are readily available. Some such useful articles are considered in some places to be status symbols when carried in a visible location, and a pleasing appearance of both the article being carried and of the carrier used to hold the article can be a factor in determining which such tool or other useful article is purchased instead of another.

Primarily, however, such sheaths and other carriers are intended to carry a tool or other useful article securely in a familiar location on one's person, where the article is easily and quickly available for use, and where the article can be replaced easily enough that one is not tempted to set it down and thus risk leaving it behind and losing it.

While many previously available carriers and sheaths have included permanent belt loops, such loops require a belt to be unfastened to mount a carrier onto the belt. Some carriers include clips or arms that can be slipped over the top of a person's belt or be removed from the belt while it is being worn. Such clips, however, have not been able to fasten a carrier to a belt as securely as is desired, particularly when a carrier is to be used to carry an expensive article or one which might be damaged if it falls.

Various sheaths for articles such as pagers or wireless telephones are not capable of securely and dependably holding heavier articles securely without the use of latches or flaps that must be unfastened and re-fastened in order to use and replace the article being carried and such an additional step required for use of such carriers may be enough to tempt a person using such a carrier to lay down an expensive tool or other article, rather than immediately replacing it into the carrier, with the result that the tool or other article is eventually left behind and lost.

Many sheaths, although secure, strong, easily used and good looking, such as some pouches or sheaths made of leather, are undesirably costly to produce and do not long maintain their good appearance in everyday use.

What is needed, then, is a carrier for attachment to a person's clothing for securely holding a useful article such as a small tool, from which such an article can easily be removed when it is needed, and into which such a tool or other article can easily be replaced. Preferably, the useful article should be clearly visible when held in such a carrier, and the carrier should be durable and attractive in appearance, yet inexpensive to manufacture.

SUMMARY OF THE INVENTION

The present invention supplies an answer to at least some of the above-mentioned needs by providing a carrier, preferably made as a unitary article of molded plastic, for receiving and securely holding an article such as a folded multipurpose tool, and including an arm that can be placed around a person's belt and then securely latched to the body of the carrier.

In a preferred embodiment of the carrier the arm can be unlatched easily from the body of the carrier when it is desired to remove the carrier from a person's belt.

In a preferred embodiment of the invention a carrier has a stiff yet resiliently flexible arm attached to a body and extending downwardly along the rear of the body, and a lower end of the arm includes a hook which can be pressed into mating engagement in a receptacle defined in the body of the carrier.

In one preferred embodiment of the carrier a fulcrum is located near the receptacle for the hook and causes the hook to pivot out of engagement with the receptacle, in response to pressure urging the arm toward the body of the carrier.

In one preferred embodiment of the invention, the carrier includes grip members mounted on elastically flexible portions of the body and arranged to grip an article being held in the carrier, holding the article securely, yet allowing the article to be removed from and replaced into the carrier without manipulation of any separate latching mechanisms.

It is a feature of one embodiment of the invention that it includes ears projecting outwardly from the body of the carrier to aid in holding the carrier against the force necessary to remove the article from the carrier.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
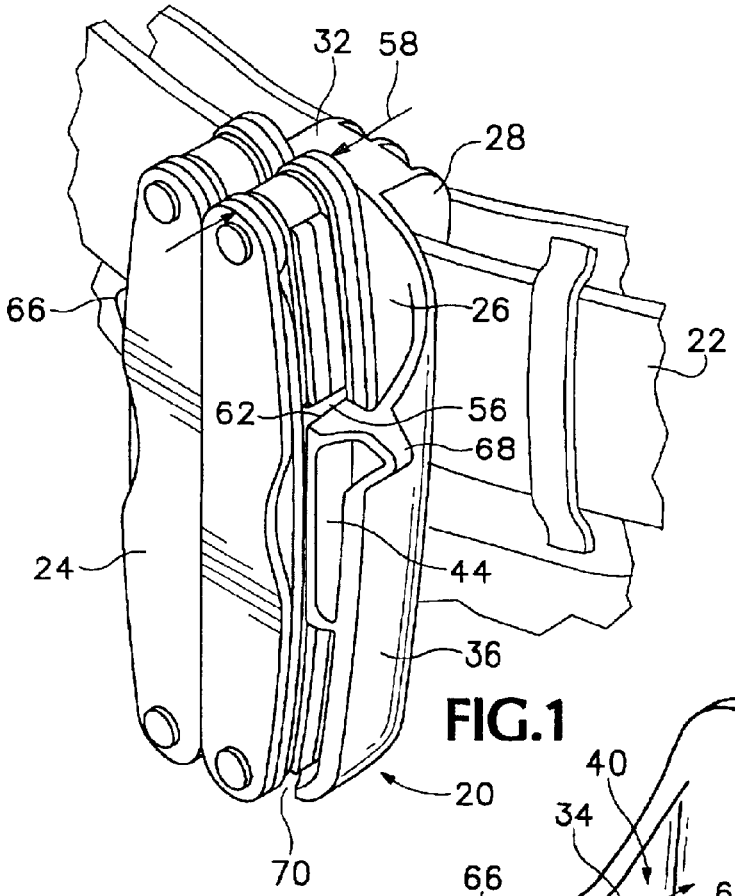
FIG. 1 is an isometric view of a carrier according to the present invention holding a folded multipurpose tool and with the carrier shown attached to a belt being worn by a person.
Figure 2:
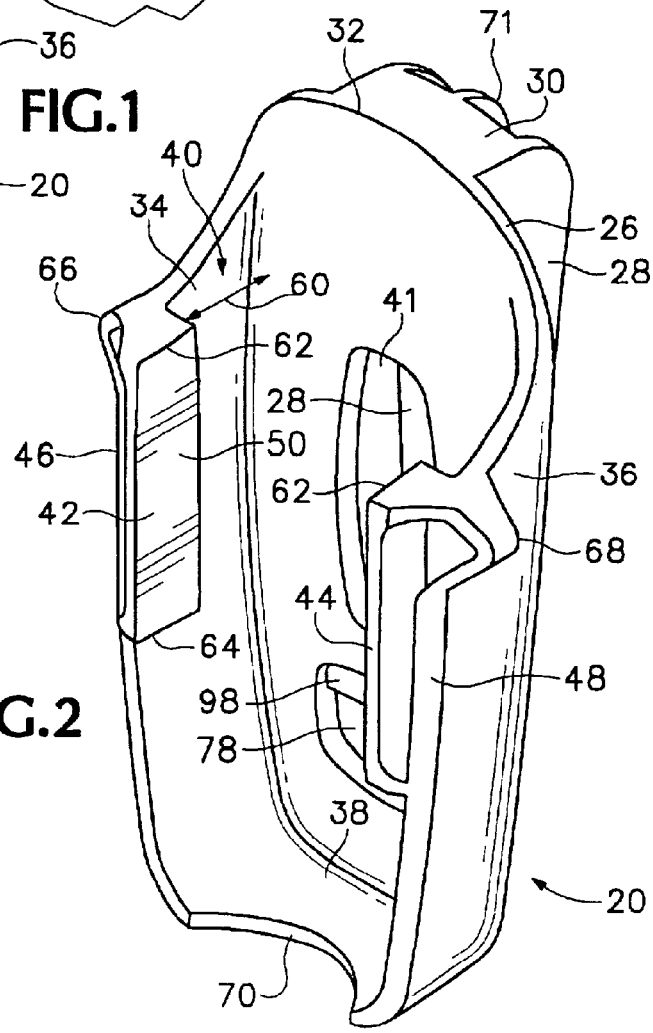
FIG. 2 is an isometric view of the tool carrier shown in FIG. 1 at an enlarged scale, taken from the front of the carrier.
Figure 3:
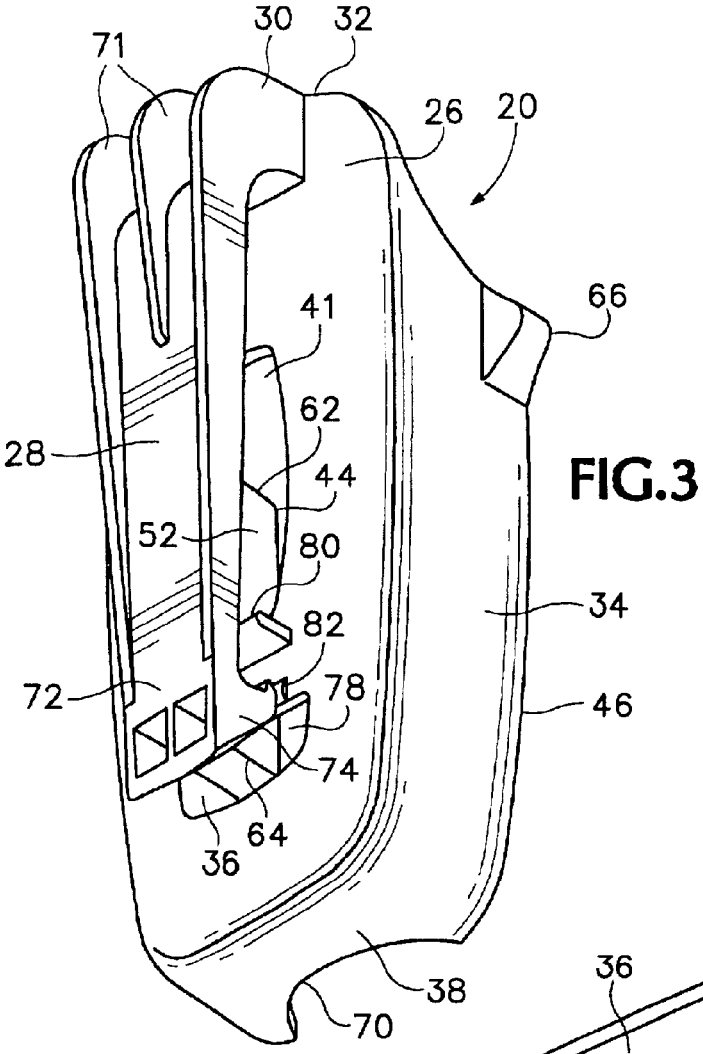
FIG. 3 is an isometric view of the carrier shown in FIG. 2, showing the rear side thereof.
Figure 4:
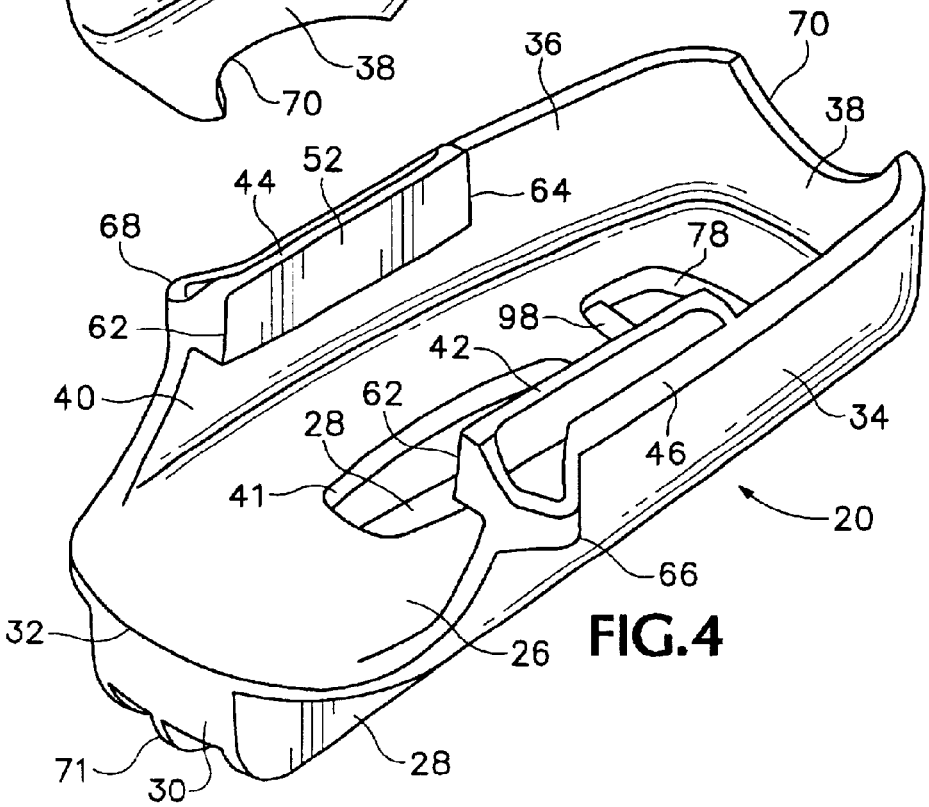
FIG. 4 is an isometric view of the carrier shown in FIG. 2 taken from the upper left front thereof, but with the carrier rotated to lie on its back.
Figure 5:
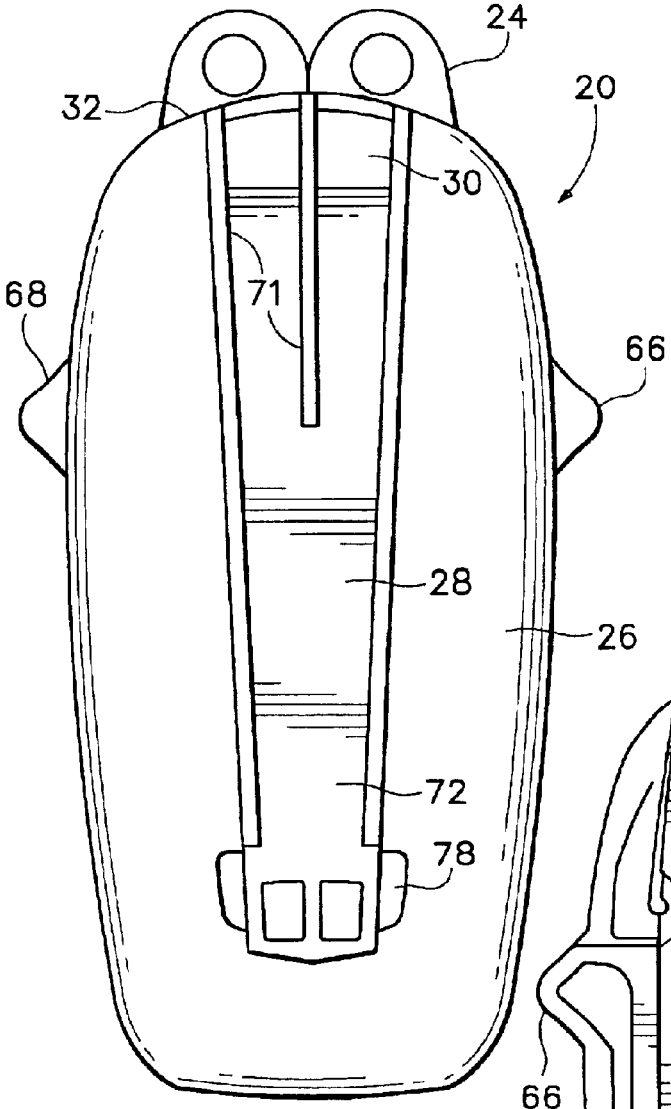
FIG. 5 is a rear elevational view of the carrier shown in FIG. 2, and showing a folded multipurpose tool held in the carrier.

Referring now to the drawings which form a part of the disclosure herein, a tool carrier 20 which is a preferred embodiment of the invention is shown in FIG. 1 in use, securely but removably mounted on a person's belt 22, and holding a folded multipurpose tool 24 securely, but in a way in which the tool 24 can be removed easily from the carrier 20 when desired.

Referring also to FIGS. 2–5, the carrier 20 may be of a molded plastic material, and may be produced by well-known injection molding methods, using a suitable plastic such as a resilient polycarbonate/polyester resin blend available from Bayer, of Pittsburgh, Pennsylvania, as its Makroblend DP4-1386. A body of the carrier 20 includes a back member 26, and a mounting device is attached to the body and includes a carrying arm 28 whose upper end 30 is attached to the rear side of the back member 26 at the top 32 of the carrier 20. A pair of side members 34 and 36 and a bottom or lower end wall 38 are formed integrally with the back member 26. The back member 26, side members 34 and 36, and lower end wall 38 cooperatively form a cavity or upwardly open space 40 in which to receive a portion of a tool 24 to be carried. An opening 41 may be provided in the back member 26 for appearance or to reduce the weight of and amount of material required for the carrier 20.

A pair of grip members 42 and 44 are carried on and extend along the upper part of the front margin portions 46 and 48 of the side members 34 and 36, and are preferably located opposite each other and oriented parallel with each other. Inner faces 50, 52 of the grip members 42, 44 are generally parallel with each other.

Figure 6:
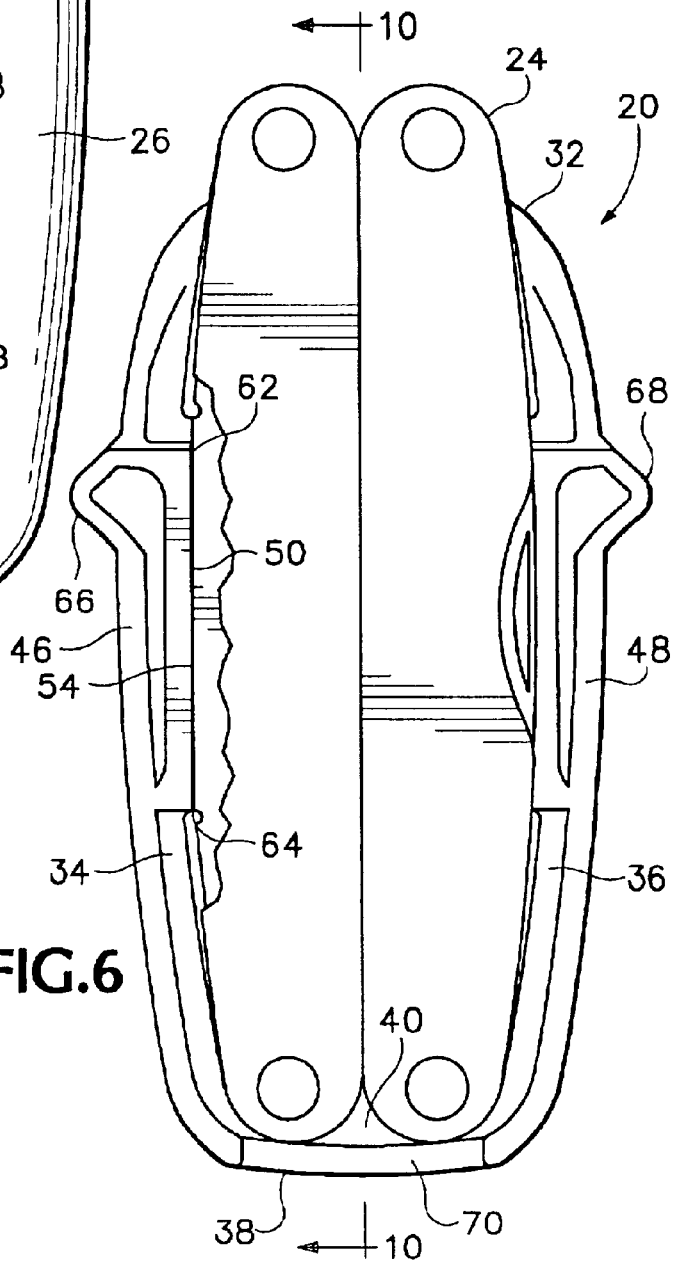
FIG. 6 is a front elevational view of the carrier shown in FIG. 2, together with the multipurpose tool, shown partially cut away.
Figure 7:
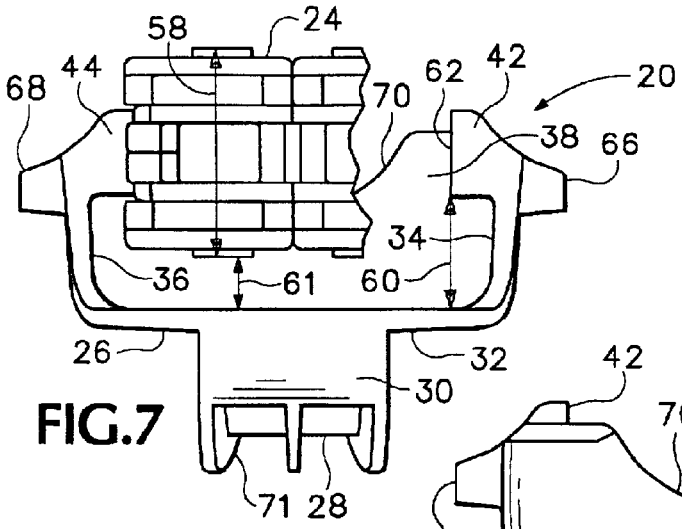
FIG. 7 is a top plan view of the carrier shown in FIG. 2, with the folded multipurpose tool shown in FIG. 1 partially cutaway, held in the carrier.
Figure 8:
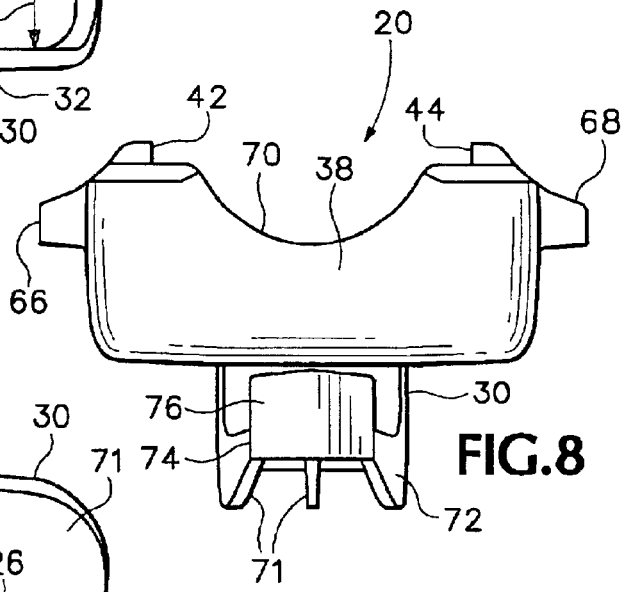
FIG. 8 is a bottom plan view of the carrier shown in FIG. 2, holding the tool shown in FIGS. 1 and 7.

The side members 34, 36 are stiff but resilient and flexible enough to be forced outward slightly as the tool 24 is placed into the carrier 20, so that inwardly directed elastic restorative forces of the side members 34 and 36 cause the grip members 42, 44 to squeeze tightly against respective adjacent surfaces of the tool 24 being carried, as shown in FIG. 6. Some tools such as the tools available from Leatherman Tool Group, Inc., of Portland, Oreg., as its "Juice" series of tools, disclosed in pending U.S. patent application Ser. No. 09/703,369 and depicted in FIGS. 6–9 herein, include parallel, flat outer surfaces 54, 56 which are depressed relative to other adjacent surfaces of the tool. The grip members 42, 44 are preferably of a size and shape to fit against such surfaces 54, 56 of a tool intended to be held in the carrier 20 to grip the tool snugly and thus keep it securely in the cavity or space 40.

Tools 24 of different thicknesses 58 may extend forward or back by different distances from such surfaces 54, 56 that are available to be clasped by the grip members 42, 44, and so the grip members 42, 44 are spaced forwardly, or outwardly, apart from the interior surface of the back member 26 by a distance 60 which allows such a tool held between the grip members 42, 44 to fit in the cavity or space 40 defined by the carrier 20. A tool having a lesser thickness 58 is still held by the grip members 42, 44, although spaced outwardly apart a small distance 61 from the interior surface of the back member 26 of the carrier 20.

When an article, such as the tool 24, is placed into the carrier 20, wider portions of the article can wedge the grip members 42 and 44 temporarily apart to allow the article to be inserted into the space 40. The elastic restorative forces of the side members 34 and 36, or of the grip members 42 and 44 themselves, urge the grip members inward toward each other, pressing the inner faces 50, 52 against the flat surfaces 54, 56 when the tool 24 is properly located, to grip the tool 24 firmly. Upper and lower edges 62, 64 of the grip members 42, 44 are preferably well-defined and angular, to prevent them from too easily following the shape of a tool 24 or other article being held in the carrier, with the grip members 42, 44 thus being wedged apart and releasing the tool undesirably. Preferably, the lower end wall 38 is located so as to support the bottom of an article to be carried, and in that instance the shape of the upper edges 62 is not critical. The lower edges 64 should conform generally to the alignment of the adjacent surfaces protruding relative to the recessed flat surfaces 54, 56, and thus are straight and horizontal in the carrier 20 shown herein, to resist undesired release of the tool 24. The upper edges 62 could be similarly aligned, although that is unnecessary for the carrier 20 to securely carry the tool 24 because of the support provided by the lower end wall 38. The upper edges 62 are therefore aligned attractively with the curvature of the upper margins of the side members 34 and 36.

A pair of ears 66, 68 each project laterally outward from a respective one of the side members 34, 36 of the carrier 20, adjacent the upper ends of the grip members 42, 44 and side wall members 34 and 36. A tool access opening 70 is provided by a curved portion of the margin of the lower end wall 38, to facilitate removal of a tool 24 from the carrier 20 when it is desired. The ears 66, 68 should be located where they are convenient and thus might be located other than at the upper ends of the grip members 42, 44. To remove the tool 24 from the carrier 20, then, a person places a thumb or finger on one or each of the ears 66, 68 to hold down the carrier 20, while pushing up on the tool 24 with another finger, which can be on the same hand, in the vicinity of the access opening 70 in the lower end wall 38 of the carrier.

Referring now to FIGS. 9–15, the carrying arm 28 has its upper end 30 securely attached to the rear or outer side of the back member 26 at the upper end or top 32 of the carrier, preferably by molding the entire carrier, including the arm 28, integrally. The arm 28 extends rearward a small distance away from the back member 26, and then extends downward along the rear or outer face of the back member 26, spaced apart from the back a distance great enough to accommodate a person's belt 22 on which the carrier 20 might be worn. The arm 26 may include ribs 71 to stiffen it, particularly at and near its upper end 30.

The distal or lower end 72 of the arm 28 includes a hook 74. Preferably, a lower face 76 of the hook is oriented at an acute angle, such as about 45°, to the general plane of the back member 26 to facilitate pushing the carrier 20 onto a belt 22 by directing the belt between the hook 74 and the back member 26 of the carrier, until the hook 74 has passed along the belt 22 to the position on the belt 22 shown in FIG. 9.

When the carrier 20 has thus been placed onto the belt 22 the hook 74 is preferably latched to the back of the carrier to securely retain the carrier in position on the belt. More specifically, the hook can be engaged matingly with a receptacle 78, as best understood with reference to FIGS. 10–15.

Figure 9:
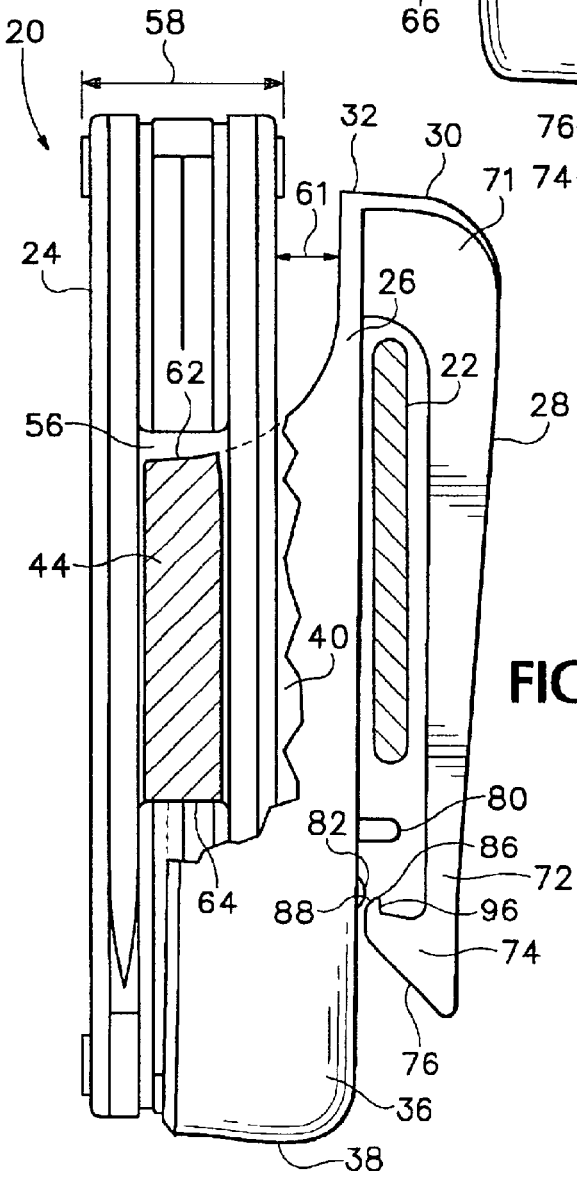
FIG. 9 is a partially cutaway side elevational view of the carrier shown in FIG. 2, holding the tool shown in FIGS. 1 and 7.
Figure 10:
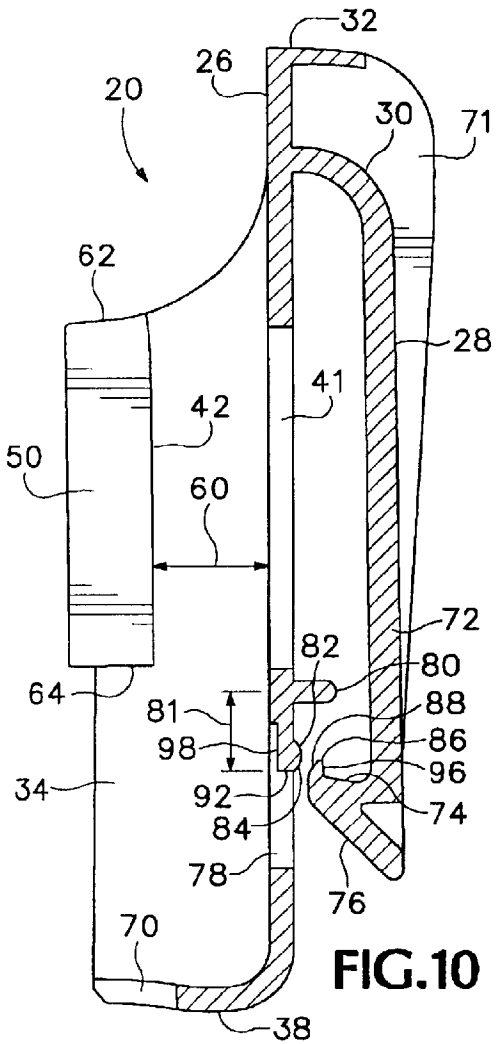
FIG. 10 is a sectional view taken along line 10—10 in FIG. 6.

When the carrier has been placed onto the belt as shown in FIG. 9, the bottom of the belt 22 is above a fulcrum 80 which projects rearwardly from the back member 26, at a location a short distance 81, for example about 0.25", from the receptacle 78, as shown in FIG. 10. In the carrier 20 shown herein, the receptacle 78 is defined by an opening extending through the back member 26, although the receptacle need not extend entirely through a thicker back member. A slightly raised and rounded rib 82 is present as part of the margin of the receptacle 78, and is part of a latch shoulder located along the upper side of the receptacle 78. A convex and generally cylindrical cam surface 84 of the latch shoulder is defined by the rib 82 so that at least a portion of the cam surface 84 forms an acute angle with respect to the general plane of the back member 26 and slopes inwardly toward the interior or opening of the receptacle 78.

Figure 12:
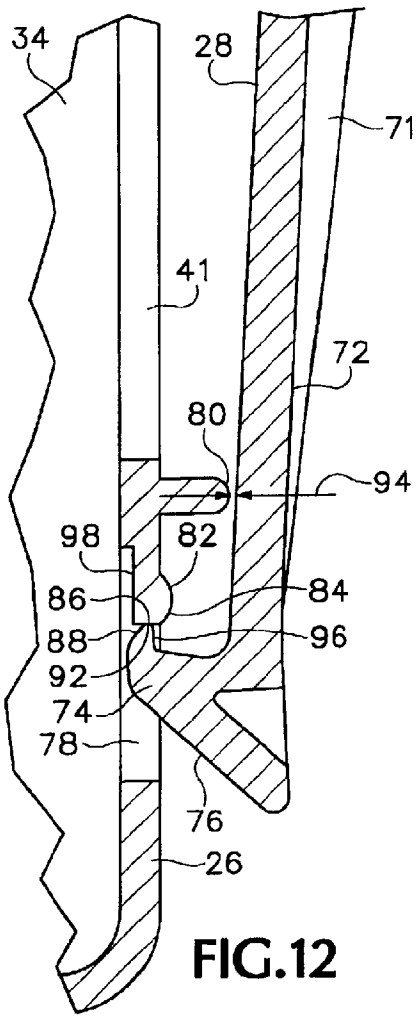
FIGS. 11–15 are detail views of a portion of the carrier support arm and its hook together with the hook receptacle portion of the body of the carrier, showing the operation of the latching interrelationship between those portions of the carrier during the procedure of latching and unlatching the hook.
Figure 11:
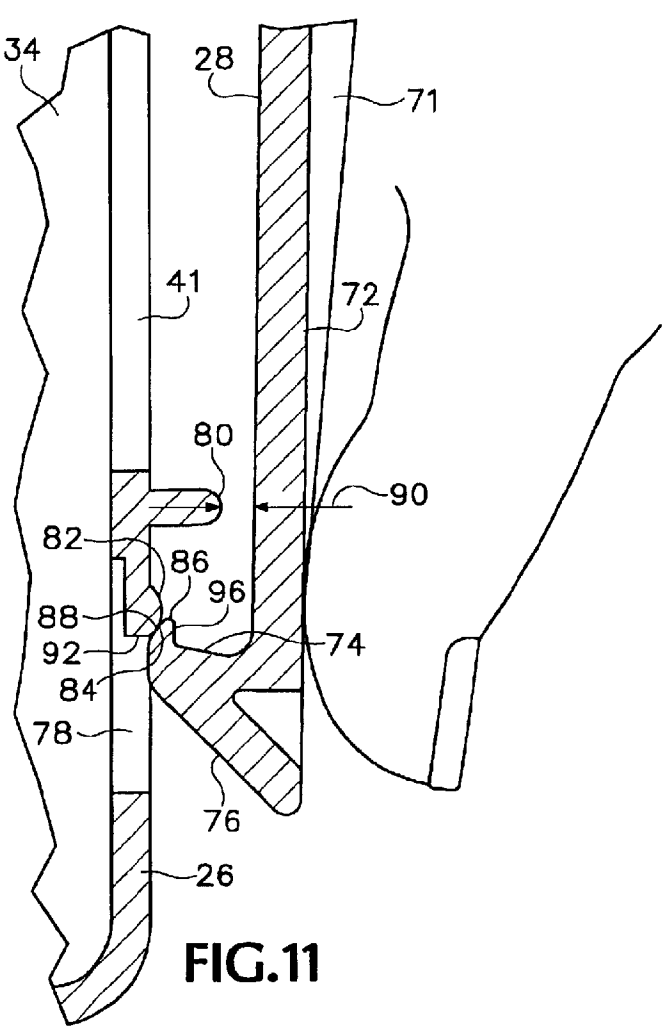

The hook 74 includes an upwardly directed lip 86, or catch, at its outer end, and an outer surface 88 of the lip is also oriented at an acute angle with respect to the plane of the back member 26. Thus, when a small amount of pressure is applied against the lower end 72 of the carrying arm 28 the arm can be deflected toward the back member 26 to bring the outer surface 88 of the lip 86 into contact against the cam surface 84 as shown best in FIG. 11, producing a reduced distance 90 between the inside of the arm 28 and the fulcrum 80 of about 0.055 inch when the surfaces 84 and 88 initially come into contact with each other. Preferably, in order to engage the hook 74 in the receptacle 78 most easily, pressure is applied to the back of the arm 28 at a location along the arm near the fulcrum 80, and slightly closer to the hook 74. Increased pressure on the arm 28 forces the outer surface 88 of the lip 86 of the hook 74 to slide along the cam surface 84 of the margin of the receptacle, which urges the lip portion 86 of the hook onto a shoulder surface 92, which, in the carrier 20 as shown in FIG. 12, is generally perpendicular to the plane of the back member 26. The restorative elastic forces in the arm 28 cause the edge of the lip 86 of the hook to press against the shoulder surface 92, and the distance between the inner side of the arm and the fulcrum is thus reduced slightly, as shown at 94, to about 0.025 inch.

Figures 13, 14, 15:
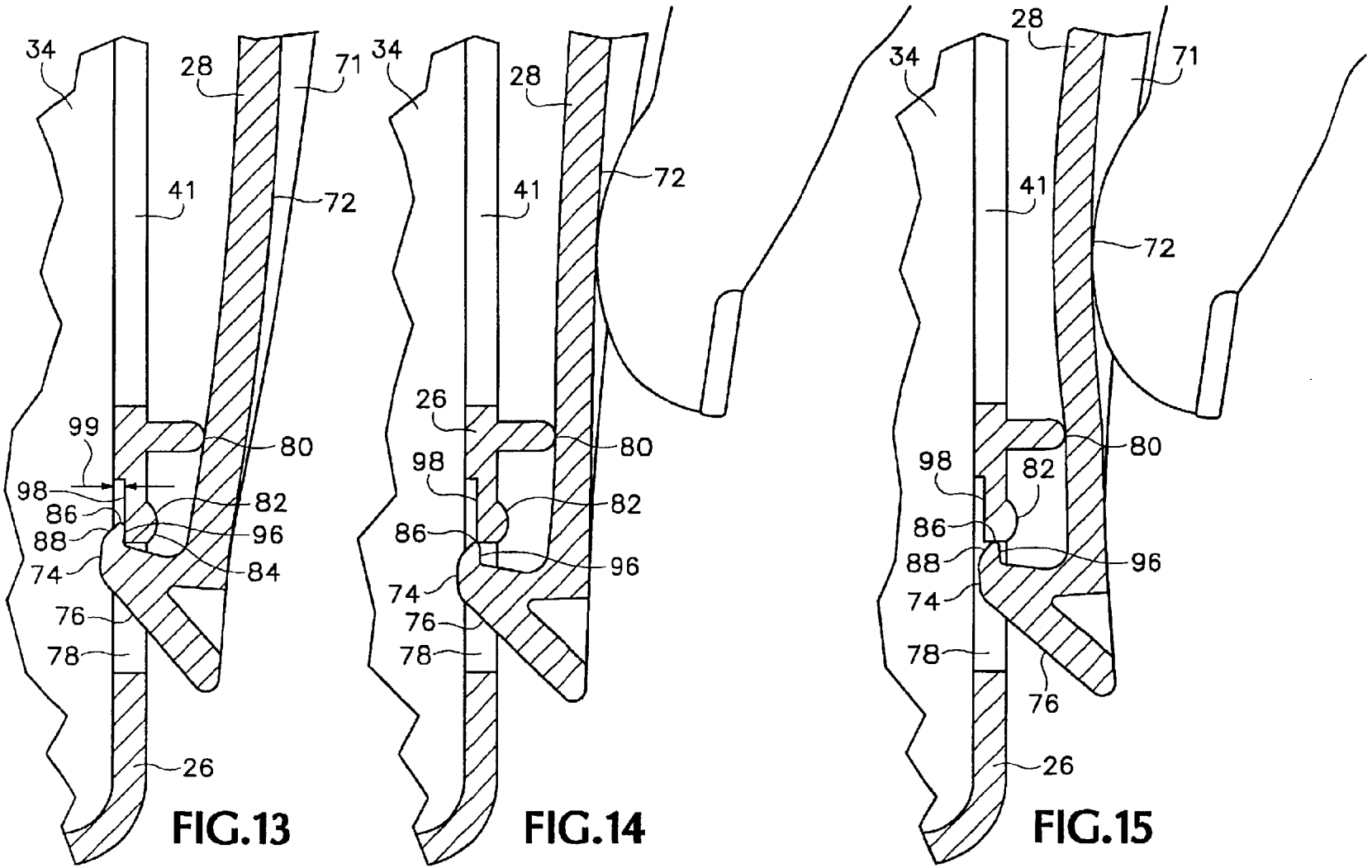

Continued or slightly increased pressure on the lower end 72 of the arm 28 carries the lip 86 further down along the shoulder surface 92, until the lip slips around the shoulder and an engagement or catch face 96 on the inside of the lip 86 slides into engagement against and alongside an opposing engagement face 98 located on the inside of the latch shoulder of the receptacle 78. When the catch face 96 and engagement face 98 are engaged alongside and in contact against each other as shown in FIG. 13, the inner side of the arm 28 rests snugly against the fulcrum 80 with a small amount of pressure, and the lower end 72 of the arm, below the location of the fulcrum, is deflected slightly downward as seen in FIG. 13, so that there is a firm engagement between the catch face 96 and the engagement face 98, and between the inside of the arm 28 and the surface of the fulcrum 80. With the hook 74 thus engaged matingly in the receptacle, outward pressure exerted on the arm 28 by the belt 22 may be able to pull the inside surface of the arm 28 out of contact with the fulcrum 80, but does not tend to disengage the lip or catch face 96 of the hook 72 from the engagement face 98 within the receptacle 78.

The engagement face 98 in the receptacle is preferably inset or recessed, as shown in FIG. 13, by a distance 99 about equal to the thickness of the lip portion 86 of the hook 74, so that the hook 74 does not project significantly into the interior of the cavity or tool carrying space 40 of the carrier 20 when the hook 74 is engaged in the receptacle 78.

In order to disengage the hook 74 from the receptacle 78, as when it is desired to remove the carrier 20 from the belt 22, pressure is applied firmly to the arm 28 at a location between the fulcrum 80 and the upper end 30 of the arm, using sufficient force to bow the arm 28 inwardly toward the body of the carrier 20 as shown in FIGS. 14 and 15. As the arm 28 is flexed in this manner, the lower end 72, including the hook 74, pivots outwardly through a small angle about the fulcrum 80 and the catch face 96 of the lip of the hook is moved along the engagement face 98 toward the shoulder surface 92 of the receptacle 78 to the position shown in FIG. 14, and is thence urged outwardly, or to the right as seen in FIG. 14 toward the position shown in FIG. 15. At that point, releasing arm 28 allows it to move outwardly, away from the back member 26, carrying the hook 74 the remainder of the way from the receptacle 78 toward the position shown in FIG. 10. The hook 74 can then be pulled away from the body of the carrier 20 as necessary for it to pass clear of the belt 22 to be lifted free.

Figure 16:
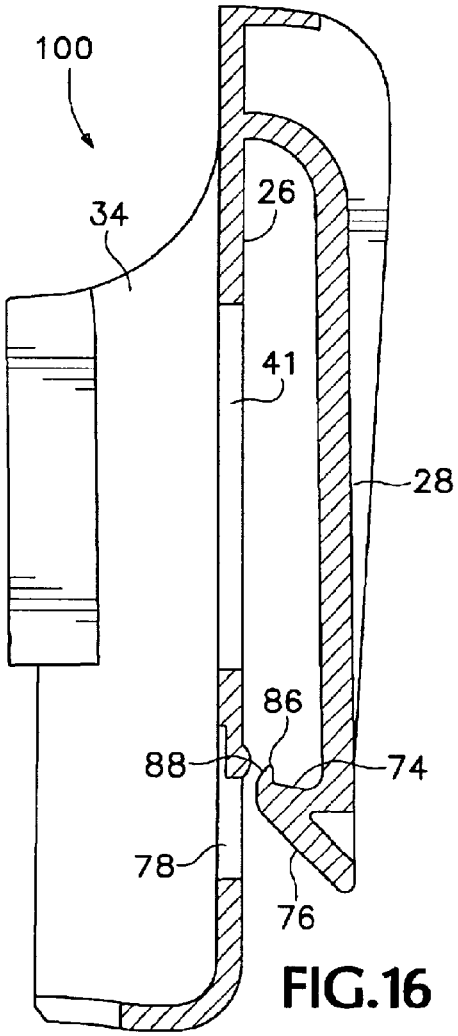
FIG. 16 is a view similar to FIG. 10, showing a carrier which is an alternative embodiment of the invention, in which there is no protruding fulcrum for the arm.

A carrier 100, shown in FIG. 16, is similar in most respects to the carrier 20, but has no fulcrum protruding from the back member 26 toward the arm 28. The hook 74 can be engaged in the receptacle 78 as in the carrier 20, but needs to be pulled to be disengaged. For example, the lower face 76 can be engaged to pull the hook 74 away from the back member 26. Alternatively, with the carrier 100 empty, the hook 74 can be disengaged from the receptacle by pushing on the outer surface 88 of the lip 86.

Figure 17:
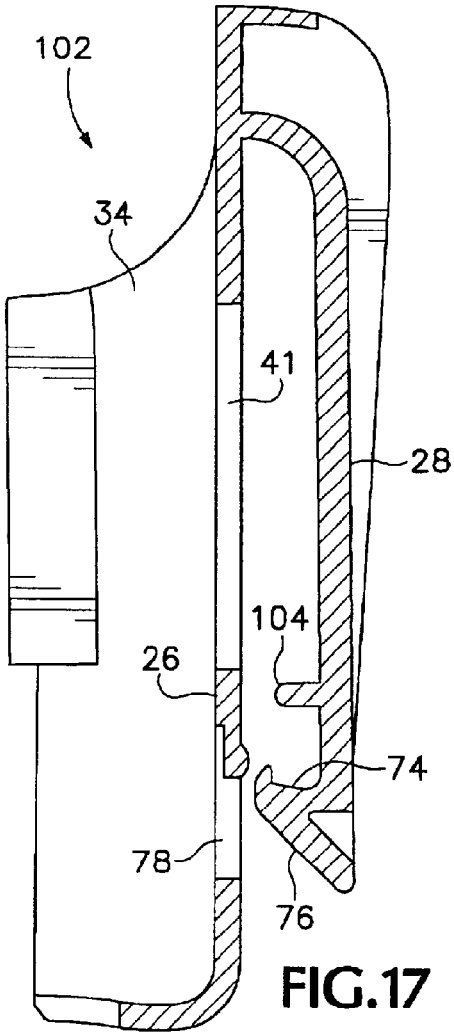
FIG. 17 is a view of a carrier which is another alternative embodiment of the invention in which the arm includes a fulcrum extending toward the body.

A carrier 102, shown in FIG. 17, is also generally similar to the carriers 20 and 100 in most respects, but has a fulcrum 104 carried on the arm 28 and extending toward the back member 26 of the body of the carrier 102. The fulcrum 104 is thus available as a center about which the hook 74 can pivot when the arm 28 is pressed and flexed toward the back member 26 as in the carrier 20, in order to disengage the hook 74 from the receptacle 78.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A carrier for an article, comprising:

(a) a body having a back member;

(b) an arm having an upper end and a lower end, including a hook facing toward said back member, said upper end being attached to said body;

(c) an upwardly directed catch carried on said hook;

(d) a receptacle included in said back member and located opposite said hook, and wherein said hook is latchingly engageable in said receptacle, and said arm is elastically biased to keep said catch engaged in said receptacle; and (e) a fulcrum located between said body and said arm and located, with respect to said arm, between said hook and said upper end in a location in which pressure on said arm toward said body between said fulcrum and said upper end disengages said hook from said receptacle.

2. The carrier of claim 1 wherein said pressure on said arm causes said hook to move through a small angle about said fulcrum as a part of disengaging said hook from said receptacle.

3. The carrier of claim 1 wherein said pressure on said arm causes a portion of said arm between said fulcrum and said upper end of said arm to flex toward said body and thereby disengages said catch from said receptacle.

4. The carrier of claim 1 wherein said arm is resiliently flexible between said fulcrum and said upper end.

5. The carrier of claim 1 wherein said arm has a resiliently flexible portion located between said fulcrum and said upper end.

6. The carrier of claim 1 wherein said fulcrum is located on said back member a small distance away from said receptacle and faces toward said arm.

7. The carrier of claim 1 wherein said fulcrum prevents said arm from moving toward said back member closer than a predetermined position.

8. The carrier of claim 1 wherein said fulcrum is mounted on said back member and projects toward said arm.

9. The carrier of claim 1 wherein said fulcrum is mounted on said arm and projects toward said back member.

10. The carrier of claim 1 wherein said catch has a first engagement face and wherein said receptacle includes a latch shoulder having a second engagement face, said first and second engagement faces being in mutual contact with each other when said hook is engaged in said receptacle.

11. The carrier of claim 10 wherein said arm moves said hook, thereby moving said first engagement face out of engagement with said second engagement face and moving said catch clear of said shoulder, when said arm is flexed by being pressed toward said back member between said fulcrum and said upper end of said arm.

12. The carrier of claim 1 wherein said receptacle includes an opening extending through said back member.

13. The carrier of claim 1 wherein said receptacle includes a cam surface followed by said hook as said hook is urged into engagement in said receptacle by pressure on said arm directed toward said back member.

14. A carrier for an article, comprising:

(a) a body having a back member, a pair of sides, and a lower end wall, said back member, sides, and lower end wall cooperatively defining a space for receiving an article;

(b) an arm having an upper end and a lower end, including a hook facing toward said back member, said upper end being attached to and integral with said body;

(c) an upwardly directed catch carried on said hook;

(d) a receptacle included in said back member and located opposite said hook, and wherein said hook is latchingly engageable in said receptacle, and said arm is elastically biased to keep said catch engaged in said receptacle; and wherein said receptacle includes an opening extending through said back member and a portion of said hook including said catch extends through said back member by way of said opening when said hook is engaged in said receptacle.

15. The carrier of claim 14 wherein said receptacle includes a cam surface followed by said hook as said hook is urged into engagement in said receptacle by pressure on said arm directed toward said back member.

16. A carrier for an article, comprising:

(a) a back member;

(b) a pair of side members constructed of a stiff but resiliently flexible material;

(c) a lower end wall, said back, said side members, and said lower end wall cooperatively defining a tool-receiving space;

(d) a mounting device attached to a rear side of said back member to mount the carrier on a person's clothing;

(e) an inwardly-projecting grip member carried on one of said side members; and (f) an ear extending laterally outward from one of said side members in position to be engaged by one's hand in connection with removing an article from said carrier.

17. The carrier of claim 16, including a respective inwardly-projecting grip member carried on each of said side members.

18. The carrier of claim 17 wherein said grip members are aligned opposite each other and facing toward each other.

19. The carrier of claim 17 wherein said grip members are spaced outwardly apart from said back member.

20. The carrier of claim 17 wherein said grip members are located upwardly apart from said lower end wall.

21. The carrier of claim 17 wherein said side members have respective upper ends and said grip members are located adjacent said upper ends.

22. The carrier of claim 16 wherein said lower end wall defines a tool access opening and said ear extends laterally outward from a location adjacent said grip member.

23. The carrier of claim 16 wherein said mounting device includes: an arm having an upper end and a lower end, said lower end including a hook facing toward said back member and said upper end being attached to said back member; an upwardly directed catch carried on said hook; and a receptacle included in said back member and located opposite said hook; and wherein said hook is latchingly engageable in said receptacle and said arm is elastically biased to keep said catch engaged in said receptacle.

24. The carrier of claim 16 in combination with a tool having a pair of outwardly-facing relatively depressed surfaces.

25. A carrier for an article, comprising:

(a) a back member;

(b) a pair of side members, each including a laterally outwardly projecting ear;

(c) a lower end wall, said back member, said side members, and said lower end wall cooperatively defining an upwardly open tool-receiving space;

(d) a mounting device attached to a rear side of said back member; and (e) a tool access opening defined in said lower end wall.

26. A carrier for an article, comprising:

(a) a back member;

(b) a pair of Bide members constructed of a stiff but resiliently flexible material;

(c) a lower end wall, said back, said side members, and said lower end wall cooperatively defining a tool-receiving space;

(d) an inwardly-projecting grip member carried on one of said side members and an ear extending laterally outward from said side member adjacent said grip member;

(e) a mounting device attached to a rear side of said back member to mount the carrier on a person's clothing; and (f) a tool access opening defined in said lower end wall.

27. The carrier of claim 26 wherein said mounting device includes: an arm having an upper end and a lower end, said lower end including a hook facing toward said back member and said upper end being attached to said back member, an upwardly directed catch being carried on said hook, and a receptacle being included in said back member and located opposite said hook, and wherein said hook is latchingly engageable in said receptacle and said arm is elastically biased to keep said catch engaged in said receptacle.

* * * * *

UNITED STATES PATENT AND TRADEMARK OFFICE

CERTIFICATE OF CORRECTION

PATENT NO. : 6,889,879 B2
APPLICATION NO. : 10/066138
DATED : May 10, 2005
INVENTOR(S) : Benjamin C. Rivera et al.

It is certified that error appears in the above-identified patent and that said Letters Patent is hereby corrected as shown below:

Column 8, line 43, “Bide” should read --side--

Column 8, line 58, “includes:” should read --includes--

Signed and Sealed this
Fifth Day of June, 2012

David J. Kappos

David J. Kappos
*Director of the United States Patent and Trademark Office*